US011286633B2

(12) United States Patent
Hernández Montes et al.

(10) Patent No.: US 11,286,633 B2
(45) Date of Patent: Mar. 29, 2022

(54) SYSTEM WITH MARKERS FOR PLACING A RETAINING PILE WITH ASYMMETRICAL REINFORCEMENT AND METHOD FOR USING SAME

(71) Applicant: ASC GRUPO ERSI, S.L.U., Madrid (ES)

(72) Inventors: Enrique Hernández Montes, Madrid (ES); Rosa Maria Pascual Vicente, Madrid (ES)

(73) Assignee: ASC GRUPO ERSI, S.L.U., Madrid (ES)

( * ) Notice: Subject to any disclaimer, the term of this patent is extended or adjusted under 35 U.S.C. 154(b) by 0 days.

(21) Appl. No.: 17/264,190

(22) PCT Filed: Aug. 9, 2018

(86) PCT No.: PCT/ES2018/070550

§ 371 (c)(1),
(2) Date: Jan. 28, 2021

(87) PCT Pub. No.: WO2020/030831

PCT Pub. Date: Feb. 13, 2020

(65) Prior Publication Data

US 2021/0269999 A1 Sep. 2, 2021

(51) Int. Cl.

| | |
|---|---|
| ***E04C 5/16*** | (2006.01) |
| ***E02D 5/30*** | (2006.01) |
| ***E02D 13/06*** | (2006.01) |

(52) U.S. Cl.

CPC ..... *E02D 13/06* (2013.01); *E02D 5/30* (2013.01); *E04C 5/168* (2013.01)

(58) Field of Classification Search

CPC ..... E02D 5/30; E04C 5/168; E04C 5/208; E04C 5/206; E04C 5/203; E04C 5/06; E04C 5/0618; E04C 5/0627

(Continued)

(56) References Cited

U.S. PATENT DOCUMENTS 1,592,671 A * 7/1926 Nichols ..... B29C 33/126 264/275
1,708,277 A * 4/1929 Martin ..... E04C 5/18 52/649.4

(Continued)

FOREIGN PATENT DOCUMENTS

CA 2686025 A1 * 5/2010
DE 3500008 A1 7/1986

(Continued)

OTHER PUBLICATIONS

Dec. 4, 2019 (WO) International Search Report—App. PCT/ES2018/070550.

*Primary Examiner* — Sunil Singh
(74) *Attorney, Agent, or Firm* — Banner & Witcoff, Ltd.

(57) ABSTRACT

The invention relates to a system with markers for placing a retaining pile with asymmetrical reinforcement and method for using same, so that the reinforcement is disposed in the correct position. The system comprises at least one positioned separator and a marker-separator attached to transverse reinforcing means, at least one marker disposed on a guide wall or sleeve, the marker-separator being aligned with the marker or separated by a distance equal to or less than a predetermined safety value. The method for using the system comprises the steps of: positioning a separator and attaching a marker-separator to the transverse reinforcing means, positioning the marker on the guide wall or sleeve; aligning the marker-separator with the marker or positioning at a distance equal to or less than a predetermined safety value, when the asymmetrical reinforcement is placed inside the guide wall or sleeve.

10 Claims, 3 Drawing Sheets

(58) Field of Classification Search
USPC ..... 405/239; 52/295, 296, 649.3, 649.8, 52/649.4, 649.6, 649.7, 741.15
See application file for complete search history.

(56) References Cited

U.S. PATENT DOCUMENTS 1,750,286 A * 3/1930 Sherwan ..... E04C 5/18 52/649.4
1,817,437 A * 8/1931 Hawkinson ..... E04C 5/18 249/83
2,612,024 A * 9/1952 Hunsucker ..... E02B 17/00 405/222
3,060,694 A * 10/1962 Holmes ..... E02D 5/385 405/239
3,257,767 A * 6/1966 Lassy ..... E04C 5/18 52/649.8
4,441,527 A * 4/1984 Tolliver ..... B21F 27/121 138/175
4,452,026 A * 6/1984 Tolliver ..... E04C 5/18 52/684
4,463,538 A * 8/1984 Dragunas ..... E04C 5/0604 52/677
4,467,995 A * 8/1984 Tolliver ..... B28B 21/56 138/175
4,627,211 A * 12/1986 Foster, Jr. ..... E04C 5/20 405/239
4,833,857 A * 5/1989 Wheeler ..... E04C 3/34 264/35
5,542,785 A * 8/1996 Cloud ..... E02D 5/34 249/83

FOREIGN PATENT DOCUMENTS

EP 0356922 A1 * 3/1990
EP 0955423 A2 * 11/1999
EP 1624128 A1 * 2/2006
ES 2344050 A1 8/2010
ES 2537254 A1 6/2015
GB 1217413 A * 12/1970
JP 8-105044 A * 4/1996
JP 2002-81173 A * 3/2002

* cited by examiner

SYSTEM WITH MARKERS FOR PLACING A RETAINING PILE WITH ASYMMETRICAL REINFORCEMENT AND METHOD FOR USING SAME

CROSS REFERENCE TO RELATED APPLICATIONS

The present application is a U.S. National Phase Application under 35 U.S.C. § 371 of PCT/ES2018/070550, filed Aug. 9, 2018, the entire contents of these applications are incorporated herein by reference in their entirety.

TECHNICAL FIELD OF THE INVENTION

The present invention is encompassed in the field of constructions and foundations, specifically in that of concrete piles that include reinforcement, specifically in which the reinforcement is asymmetrical.

BACKGROUND OF THE INVENTION

An asymmetrical reinforcement comprises a plurality of longitudinal bars, the reinforcement or longitudinal reinforcement, arranged parallel to each other, the ends of which are arranged forming a circumference, and transverse reinforcing means, the reinforcement or transverse reinforcement, in the form of circular frames or at least one helix, externally surrounding the longitudinal bars; what provides asymmetry is that at least two longitudinal bars have different diameters and/or because of the difference in distance between bars. The asymmetrical reinforcement thus formed is usually inserted into a guide wall or sleeve to form a retaining pile.

A retaining pile with asymmetrical reinforcement, for the sake of shortness commonly known as "asymmetrical pile" is usually manufactured, depending on its length, in several sections, i.e., several reinforcements arranged consecutively, usually in two sections, although they can be as many as the specific construction requires. It is usual for each section to be several meters long, for example 12 meters; the most common screens consisting of several piles are in the range of 12 meters to 20 meters.

If a cross section of an asymmetrical pile is observed, it can be seen that it has a higher density of bars in certain parts of the circumference. An operator is assumed to know that the reinforcement density has to be parallel to the plane formed by the piles, and that centers the reinforcement correctly. Even so, there are several possible ways of placing the asymmetrical reinforcement, leading to a possible placement error. For its correct placement, the construction plans must be followed, since a simple change can make the pile not resist the action for which it was designed.

On the other hand, separators are known that serve to guarantee the reinforcement coating on a reinforced concrete element, either during the placement of the reinforcement and the formwork, or during concreting (for example, http://www.arquisolux.com/producto.php/es/10103/4).

DESCRIPTION OF THE INVENTION

The present invention is established and characterised in the independent claims, while the dependent claims describe other characteristics thereof.

The object of the invention is a system with markers for placing a retaining pile with asymmetrical reinforcement and method for using same. The technical problem to be solved is to configure the system and establish the steps of its use so that the reinforcement is disposed in the correct position and accordingly the adequate resistant characteristics of the formed pile are obtained.

In view of the foregoing, the present invention refers to a system with markers for placing a retaining pile with asymmetrical reinforcement, the asymmetrical reinforcement comprises a plurality of longitudinal bars arranged parallel to each other, the ends of which are arranged forming a circumference and transverse reinforcing means, in the form of circular frames or at least one helix, externally surrounding the longitudinal bars, at least two longitudinal bars have different diameters and/or between several consecutive longitudinal bars there are at least two different distances, i.e., asymmetry is achieved by the difference in diameters, or also by the difference in distance between bars, one or both of the conditions at the same time being possible; at least one separator is arranged on the transverse reinforcing means, it is only arranged, without having a fixed site and being able to move along the transverse reinforcing means; the asymmetrical reinforcement is inserted into a guide wall or sleeve to form the retaining pile, as is known in the state of the art.

The system is characterised by also comprising:

at least one marker-separator attached to transverse reinforcing means, at least one marker disposed on the guide wall or sleeve, where the marker-separator is aligned with the marker or separated by a distance, D, equal to or less than a predetermined safety value, Dmax, when the asymmetrical reinforcement is arranged inside the guide wall or sleeve.

"Separator" means the known separators that have the function of separating the asymmetrical reinforcement sufficiently from the guide wall or sleeve so that the concrete creates an suitable wall and preventing the reinforcement from sticking to the guide wall or sleeve. "Marker-separator" means a separator that is not only that, but also has a function of marking a position in relation to the so-called "marker", which only has said marking function and not a separating function.

Preferably, the marker-separator differs from the separator, such as, for example, by a difference in colour, although it can also be a constitutive characteristic, as if both marker-separator and separator were wheel-type and one of them has a bevelled outer area, for example the marker-separator, which clearly differentiates it from the separator. However, this is not a strictly necessary condition, and all of them can be externally the same, the user knowing which is of one type and which is of another, which on the other hand can be simple since the markers-separators are arranged aligned and fixed in their position, as explained later, while the separators are not fixed and moreover randomly arranged.

The predetermined safety value, Dmax, is unique for each designed pile and is determined by the following expressions:

$$M(\theta)=M\text{design} \quad \text{(equation 1)}$$

$$D\ \max=R*\theta \quad \text{(equation 2)}$$

where:

M(θ) is the resistant moment based on the rotation, of the cross section with respect to its position of maximum resistance;

Mdesign is the moment required of the cross section;

Dmax is the predetermined safety value, i.e., the distance specified on each marker-separator;

R is the distance from the centre of the pile to the marker positioned on the guide wall or sleeve.

From equation 1, θ is deduced by numerical calculation and from equation 2, Dmax is determined. Dmax is a unique value for each pile and must be calculated for each case according to equations 1 and 2 discussed here.

The invention also refers to the method of using the described system, in which a separator is arranged on the transverse reinforcing means, characterised in that it further comprises the following steps:

a) attaching at least one marker-separator to the transverse reinforcing means of an asymmetrical reinforcement of a retaining pile, b) positioning a marker on a guide wall or sleeve, which indicates a position of the asymmetrical reinforcement on the retaining pile to be formed;

c) alignment of the marker-separator with the marker or positioning at a distance, D, equal to or less than a predetermined safety value, Dmax, when the asymmetrical reinforcement is placed inside the guide wall or sleeve.

Subsequently and as is known, concrete is poured into the guide wall or sleeve in which the asymmetrical reinforcement is arranged, in order to obtain, after setting, a retaining pile.

Thus, the object of the invention is achieved with the advantage that the positioning of the asymmetrical reinforcement is done in a simple and reliable way, through a simple visual appreciation, without the need for any equipment or machinery, which is very useful in constructions where large and numerous reinforcements are handled for many days and by different operators.

BRIEF DESCRIPTION OF THE DRAWINGS

This specification is supplemented by a set of drawings illustrating the preferred embodiment and never intended to limit the invention.

DETAILED DESCRIPTION OF THE INVENTION

Figure 1:
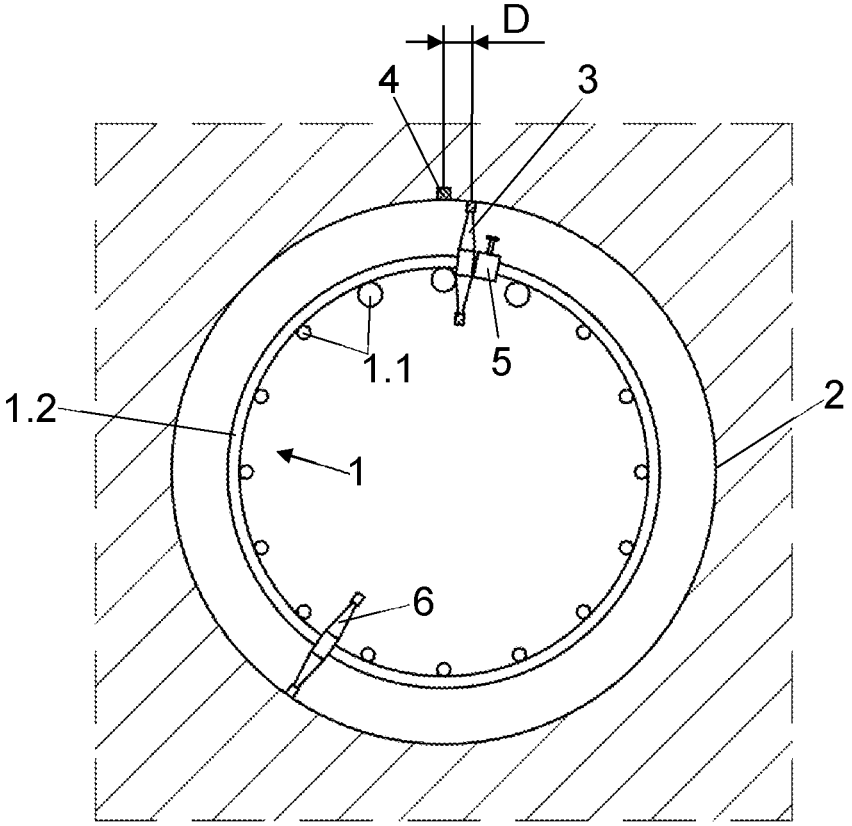
FIG. 1 represents a plan view of a system with markers for placing a retaining pile with asymmetrical reinforcement, with a separator and a marker-separator positioned on the asymmetrical reinforcement and a marker on a guide wall or sleeve, with the reinforcement placed in position before pouring the concrete.

FIG. 1 shows a plan view of a system with markers for placing a retaining pile with asymmetrical reinforcement, the asymmetrical reinforcement (1) comprises a plurality of longitudinal bars (1.1) arranged parallel to each other, the ends of which are arranged forming a circumference, and transverse reinforcing means (1.2), in the form of circular frames or at least one helix, externally surrounding the longitudinal bars (1.1), at least two longitudinal bars (1.1) have different diameters, as shown, although also between several consecutive longitudinal bars (1.1) there can be at least two different distances and thus achieve asymmetry, at least one separator (6) is arranged on the transverse reinforcing means (1.2), as can be seen, being able to move until colliding with the longitudinal bars (1.1), the asymmetrical reinforcement (1) is inserted in a guide wall or sleeve (2) to form the retaining pile, by pouring concrete, not shown, into the gap of the guide wall or sleeve (2).

Figure 2:
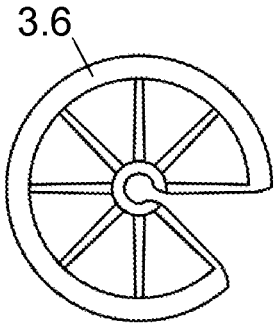
FIG. 2 represents a profile view of a wheel-type separator or marker-separator.

The system shown in FIG. 1 further comprises:

at least one marker-separator (3) attached to transverse reinforcing means (1.2), in the embodiment shown it is a wheel-type linear separator, in detail in FIG. 2, of the type known, which also serves to correctly distance the reinforcement (1) from the guide wall or sleeve (2) and thus obtain the appropriate concrete wall thickness;

at least one marker (4) disposed on the guide wall or sleeve (2), which in the embodiment shown is a mark of paint, which is very simple and practical because on site it does not require more than carrying a paint or spray can, although it can be any other type such as a notch or plate;

where the marker-separator (3) is aligned with the marker (4), not shown in the figure, or separated by a distance, D, equal to or less than a predetermined safety value, Dmax, when the asymmetrical reinforcement (1) It is arranged inside the guide wall or sleeve (2).

Figure 3:
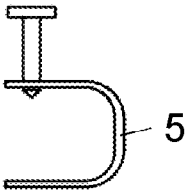
FIG. 3 shows a perspective view of a stop.
Figure 4:
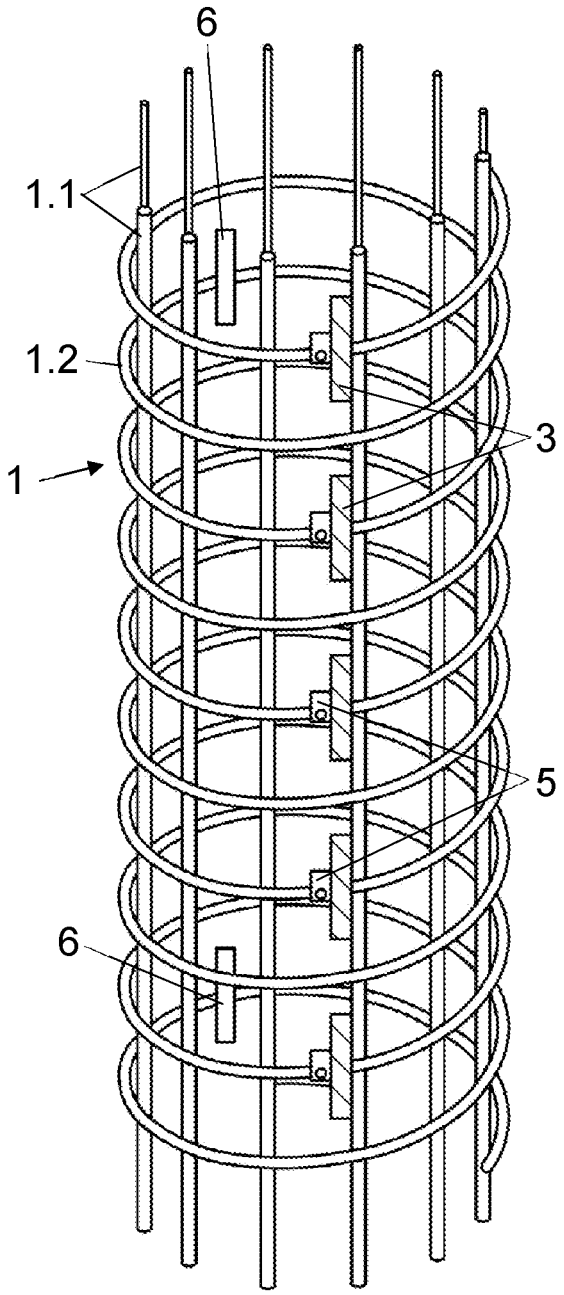
FIG. 4 represents a perspective view of an asymmetrical reinforcement with transverse reinforcing means, in the form of a helix, randomly arranged separators and markers-separators and stops arranged aligned on alternate turns of the helix.
Figure 5:
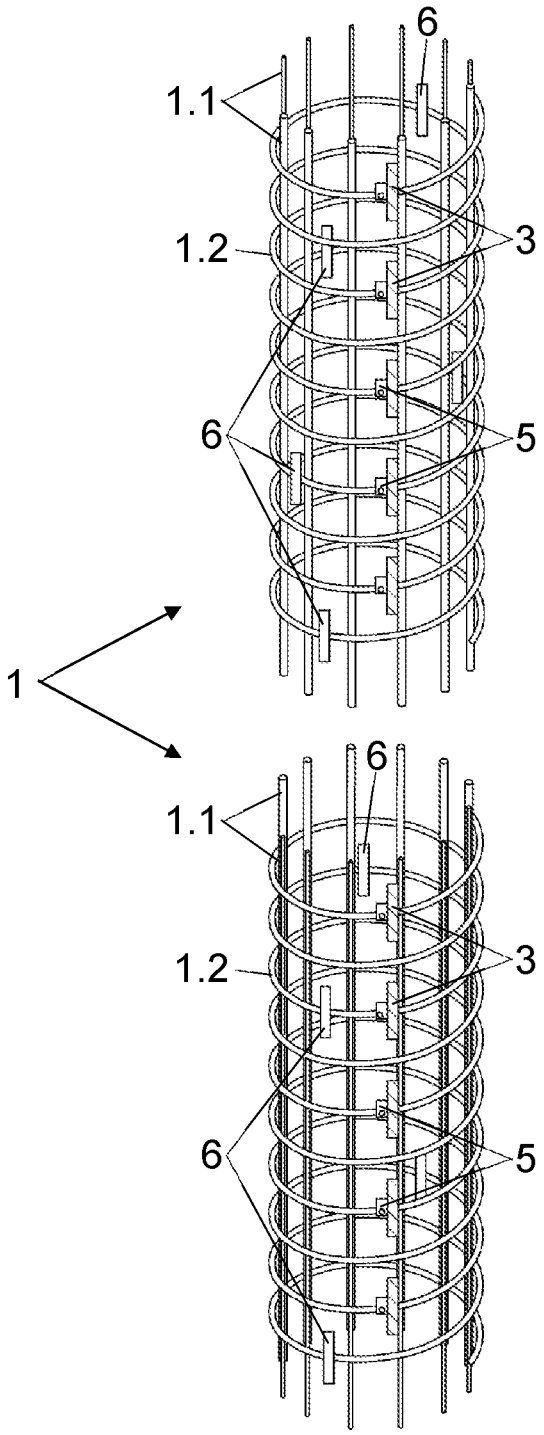
FIG. 5 represents a perspective view of an asymmetrical reinforcement formed by two sections, these represented somewhat separated, for clarity, although they are usually arranged abutting one after the other.

As shown in FIGS. 1, 4 and 5, to fix the position of each marker-separator (3) it is advantageous to include a stop (5) arranged on the transverse reinforcing means (1.2) and after the marker-separator (3), such that said marker-separator (3) is retained on one side by a longitudinal bar (1.1) and on the other by the stop (5). An option shown in FIG. 3 is that the stop (5) is a U-shaped configuration, which is easily placed around a bar, attaching it thereto by means of a threaded stem that allows it to be approached or moved away with one hand or even with a tool if necessary.

To improve the positioning in reinforcements of a certain length, one option is to have a plurality of marker-separators (3) arranged in a row extending longitudinally along the asymmetrical reinforcement (1), as shown in FIGS. 4 and 5. In this way, while the asymmetrical reinforcement (1) is being arranged on its guide wall or sleeve (2), it can be gradually placed in its correct position, which avoids this having to be done when the asymmetrical reinforcement (1) is finally in place, which would force it to be lifted once again if wanting to correct its position, with the expense of resources and time that this entails.

FIG. 5 represents a perspective view of a symmetrical reinforcement (1) composed of two sections, the upper section is like the representation of FIG. 4, while the lower section changes the positioning of longitudinal bars (1.1), so that the markers-separators (3) and the stops (5) are arranged in the upper section on the longitudinal bars (1.1) of greater diameter, while in the lower section they are arranged on the longitudinal bars (1.1) of smaller diameter. Several separators (6) are represented, which, as usually the case, are arranged randomly.

Thus, the markers-separators (3) arranged in a row facilitate correct assembly when several sections of reinforcement have to be connected, avoiding the placement error. It must be taken into account that even if there is no rotation error (for example, D=0), in a pile made up of two sections there are four ways to place it and only one is correct.

In addition, once the reinforcement has been placed in its final position, it is possible to determine that the positioning error, D, is less than the pre-established value, Dmax. Note here the different denomination, as it is also known, of the distance, D, of separation between marker-separator (3) and marker (4)-positioning error-, and to the predetermined safety value for said distance, Dmax, -pre-established value of separation or positioning-.

Another advantageous option is that the system includes a label, not shown in the figures, with the predetermined safety value, Dmax, and attached to the asymmetrical reinforcement (1) and/or to the guide wall or sleeve (2). In this way, the operator has the distance D to be applied immediately in view without the need of checking a plan or having specialised knowledge of interpretation of construction plans. The label can be arranged on any of the elements, asymmetrical reinforcement (1) and/or on the guide wall or sleeve (2), on one of them or even on both at the same time; and it can be of any known type: on paper with adhesive, metallic and attached with screws or rivets, etc.

The procedure for using the described system comprises the step of positioning a separator (6) on the transverse reinforcing means (1.2) and in addition the following steps:

a) attaching at least one marker-separator (3) to the transverse reinforcing means (1.2) of an asymmetrical reinforcement (1) of a retaining pile; for example, for the embodiment shown in FIGS. 1, 4 and 5 the wheel-type one would be arranged as shown;

b) positioning a marker (4) on a guide wall or sleeve (2), which indicates a position of the asymmetrical reinforcement (1) on the retaining pile to be formed; for example, for the embodiment shown in FIGS. 1, 4 and 5 it would be done by painting;

c) alignment of the marker-separator (3) with the marker (4) or positioning at a distance, D, equal to or less than a predetermined safety value, Dmax, when the asymmetrical reinforcement (1) is placed inside the guide wall or sleeve (2); the embodiment of FIG. 1 shows when the distance, D exists, if it were aligned, the marker-separator (3) would be shown just after the marker (4).

An advantageous option shown in FIGS. 1, 4 and 5 is to arrange a stop (5) on the transverse reinforcing means (1.2) and after the marker-separator (3), so that said marker-separator (3) is retained on one side by a longitudinal bar (1.1) and on the other by the stop (5). Thus, in a simple way the retention of the marker-separator (3) in its position is achieved and without movement when the concrete is poured.

Preferably, Dmax is determined by the following expressions:

$$M(\theta)=M\text{design} \quad \text{(equation 1)}$$

$$D\ \text{max}=R*\theta \quad \text{(equation 2)}$$

where:

M(θ) is the resistant moment based on the rotation, θ, of the cross section with respect to its position of maximum resistance;

Mdesign is the moment required of the cross section;

Dmax is the predetermined safety value;

R is the distance from the centre of the pile to the marker (4) positioned on the guide wall or sleeve (2).

In FIGS. 1, 4 and 5, each marker-separator (3) differs from the separator (6) by being striped, which represents a characteristic of external appearance, such as, for example, by a difference in colour, although it can also be a constitutive characteristic, as if both marker-separator and separator were wheel-type, as shown, and one of them has a bevelled outer area, for example the marker-separator, which clearly differentiates it from the separator. Although such differentiation is advantageous, it is not limiting, as explained above.

The invention claimed is:

1. System with markers for placing a retaining pile with asymmetrical reinforcement, the asymmetrical reinforcement comprises: a plurality of longitudinal bars arranged parallel to each other, the ends of which are arranged forming a circumference, and a transverse reinforcement in the form of circular frames or at least one helix, externally surrounding the longitudinal bars, at least two longitudinal bars have different diameters and/or between several consecutive longitudinal bars there are at least two different distances, at least one separator is arranged on the transverse reinforcement, the asymmetrical reinforcement being configured to be inserted into a guide wall or sleeve to form the retaining pile, and separated from said guide wall or sleeve by the at least one separator, the system including:

at least one marker-separator attached to the transverse reinforcement, at least one marker being disposed on the guide wall or sleeve, wherein the at least one marker-separator is aligned with the at least one marker or the at least one marker-separator and the at least one marker are separated by a lateral distance, D, equal to or less than a predetermined safety distance value, Dmax, when the asymmetrical reinforcement is arranged inside the guide wall or sleeve.

2. System according to claim 1 wherein the predetermined safety distance value, Dmax, is determined by the following expressions:

$$M(\theta)=M\text{design} \quad \text{(equation 1)}$$

$$D\ \text{max}=R*\theta \quad \text{(equation 2)}$$

where:

M(θ) is the resistant moment based on the rotation of a cross section of the retaining pile with respect to its position of maximum resistance;

Mdesign is the moment required of the cross section of the retaining pile;

Dmax is the predetermined safety distance value;

R is the distance from the centre of the retaining pile to the at least one marker positioned on the guide wall or sleeve.

3. System according to claim 1 that further comprises a stop arranged on the transverse reinforcement and after the at least one marker-separator, so that said at least one marker-separator is retained on one of its sides by a longitudinal bar of said plurality of longitudinal bars and on the other side of said at least one marker-separator by the stop.

4. System according to claim 1, wherein the at least one marker-separator further comprises a plurality of marker-separators arranged in a row extending longitudinally along the transverse reinforcement.

5. System according to claim 4, which further comprises a label with the predetermined safety distance value and attached to the asymmetrical reinforcement and/or to the guide wall or sleeve.

6. System according to claim 1, wherein the at least one marker-separator is a wheel-type linear separator.

7. System according to claim 1, wherein the at least one marker is a mark of paint, notch or plate on the guide wall or sleeve.

8. Method of using a system with markers for placing a retaining pile with asymmetrical reinforcement, the asymmetrical reinforcement including a plurality of longitudinal bars arranged parallel to each other, the ends of which are arranged forming a circumference, and a transverse reinforcement in the form of circular frames or at least one helix, externally surrounding the longitudinal bars, at least two longitudinal bars have different diameters and/or between several consecutive longitudinal bars there are at least two different distances, at least one separator is arranged on the transverse reinforcement, the asymmetrical reinforcement being configured to be inserted into a guide wall or sleeve to form the retaining pile, and separated from said guide wall or sleeve by the at least one separator; the method further comprises the following steps:

a) attaching at least one marker-separator to the transverse reinforcement of the asymmetrical reinforcement of the retaining pile, b) positioning a marker on said guide wall or sleeve, which indicates a position of the asymmetrical reinforcement on the retaining pile to be formed;

c) alignment of the least one marker-separator with the marker or positioning at a distance, D, equal to or less than a predetermined safety distance value, Dmax, when the asymmetrical reinforcement is placed inside the guide wall or sleeve.

9. Method according to claim 8, wherein the predetermined safety distance value, Dmax is determined by the following expressions:

$$M(\theta)=M\text{design} \quad \text{(equation 1)}$$

$$D\ \max=R*\theta \quad \text{(equation 2)}$$

where:

M(θ) is the resistant moment based on the rotation of the cross section of the retaining pile with respect to its position of maximum resistance;

Mdesign is the moment required of the cross section of the retaining pile;

Dmax is the predetermined safety distance value;

R is the distance from the centre of the retaining pile to the marker positioned on the guide wall or sleeve.

10. Method according to claim 8, wherein a stop is arranged on the transverse reinforcement and after the at least one marker-separator, so that said at least one marker-separator is retained on one of its sides by a longitudinal bar of said plurality of longitudinal bars and on the other side of said at least one marker-separator by the stop.

* * * * *